US005690188A

United States Patent [19]

Takakusaki et al.

[11] Patent Number: 5,690,188

[45] Date of Patent: Nov. 25, 1997

[54] ELEVATOR DOOR SYSTEM

[75] Inventors: Yasufumi Takakusaki; Yuichiro Kimura, both of Tokyo, Japan

[73] Assignee: Kabushiki Kaisha Toshiba, Kawaski, Japan

[21] Appl. No.: 610,932

[22] Filed: Mar. 5, 1996

[30] Foreign Application Priority Data

Mar. 10, 1995 [JP] Japan ..... 7-050941

[51] Int. Cl.[6] ..... B66B 13/12

[52] U.S. Cl. ..... 187/319; 187/330

[58] Field of Search ..... 187/319, 324, 187/330, 334; 49/116, 120

[56] References Cited

U.S. PATENT DOCUMENTS

| | | | |
|---|---|---|---|
| 2,307,353 | 1/1943 | Bond | 187/31 |
| 3,065,826 | 11/1962 | Tucker, Jr. | 187/52 |
| 4,947,964 | 8/1990 | Husmann | 187/319 |

OTHER PUBLICATIONS

Patent Abstracts of Japan, vol. 016, No. 464 (M-1316), Sep. 28, 1992, JP-A-04 164797, Jun. 10, 1992.

Patent Abstracts of Japan, vol. 95, No. 009, Oct. 31, 1995, JP-A-07 144858, Jun. 6, 1995.

*Primary Examiner*—Kenneth Noland

*Attorney, Agent, or Firm*—Oblon, Spivak, McClelland, Maier & Neustadt, P.C.

[57] ABSTRACT

An elevator door system including a landing door, a car door provided on a car, a latch device for locking the landing door when the landing door is closed. The elevator door system also includes a door locking device provided on the landing door composed of a coupling plate for coupling with the car door, an unlocking plate provided in parallel with the coupling plate, and a link for moving the unlocking plate toward the coupling plate. The elevator door system further includes a first linking mechanism for linking the door locking device with the latch device, and a coupling device provided on the car door composed of a pair of coupling rollers for coupling the car door with the landing door. One of the coupling rollers pushes the unlocking plate toward the coupling plate when the car lands the landing floor. A displacement of the unlocking plate caused by being pushed toward the coupling plate by the link is applied to the latch device. The latch device unlocks the landing door when the displacement of the unlocking plate is applied. The coupling device couples the car door with the landing door by pushing the door locking device when the car lands the landing floor and after the landing door is unlocked, and then the car door and the landing door are moved in one unit.

5 Claims, 11 Drawing Sheets

(DOOR: CLOSED)

(LANDING DOOR: UNLOCKED)

(COMPLETELY COUPLED)

(DOOR: CLOSED)

(DOOR: OPEN)

ELEVATOR DOOR SYSTEM

BACKGROUND OF THE INVENTION

1. Field of the Invention

This invention relates to an elevator door system, and more particularly to an elevator door system in which a landing door is opened or closed in one unit with a car door.

2. Description of the Related Art

A conventional elevator entrance is generally composed of jamb, a car door, a landing door and others. The car door and the landing door are in such a relation that the car door unlocks the locking of the landing door and is coupled with the landing door when an elevator car lands a landing floor and thus, the landing door opens/closes jointly with the opening/closing motion of the car door.

One example of a conventional elevator door system composed of a landing door and a car door will be described in the following referring to the drawings. Hereinafter, the car door and the landing door at one side only will be described unless otherwise described. FIGS. 9 and 10 show the backs of a car door 4 and a landing door 1 when doors 4 and 1 are closed, respectively. In FIGS. 9 and 10, each of landing doors 1 is kept locked by a locking lever 3 of a locking device 2 when it is kept closed. When car doors 4 are respectively coupled with landing doors 1, a retiring cam 6 at the car door side provided on the end of a car frame 5 operates to unlock the locking of landing doors 1.

An unlocking roller 9 is provided at an end of a header case 7 of landing doors 1 corresponding to the position of a bow 8 of retiring cam 6. A shaft 9B is provided in header case 7. Unlocking roller 9 is attached at one end of shaft 9B via a lever 9A. Unlocking levers 3 are attached to shaft 9B and two positions. When unlocking roller 9 is pushed by bow 8 of retiring cam 6, shaft 9B is rotated and thereby the locking of landing doors 1 by locking levers 3 is unlocked. FIG. 11(*a*) shows the locked state of retiring cam 6 and landing door 1 when landing door 1 is closed and the car is traveling, while FIG. 11(*b*) shows the unlocked state of retiring cam 6 and landing door 1 when landing door 1 is opened.

Locking mechanism of landing door 1 is in the construction as described below. When landing door 1 is closed and the car is traveling, retiring cam 6 is in such a state wherein bow 8 has been retracted by lifting a rod 11 by exciting a solenoid (an electromagnet) 10, as shown in FIG. 11(*a*) and in a chain double-dashed line in FIG. 8.

When the car lands, solenoid 10 of retiring cam 6 is released according to a command from a controller (not shown), and thereby rod 11 is pushed downward by a spring 12A and blow 8 is pushed forward by the rotation of link 12B as shown in a continuous line in FIG. 8. Then, unlocking roller 9 of landing door 1 is pushed by bow 8 as shown in FIG. 11(*b*), shaft 9B is rotated counterclockwise via lever 9A, and thereby locking lever 3 which is restricting landing door 1 from moving, is rotated to unlock the looking of landing door 1. While landing door 1 is kept open, bow 8 pushes continuously unlocking roller 9.

When a door closing command is given from the controller (not shown), solenoid 10 is excited, rod 11 is lifted and row 8 is retracted as shown in a chain double-dashed line in FIG. 8. As being applied with a force constantly rotating clockwise in FIG. 11 by a return spring (not shown), locking lever 9 rotates and landing door 1 is thus locked as shown in FIG. 11(*a*).

Landing door 1 is coupled with car door 4 by a coupling plate 12 of landing door 1 and a coupling device 13 of car door 4 as shown in FIGS. 9 and 10. That is, when a door machine 14 provided on the car frame is operated, a lever 15 rotates counterclockwise, a link 17 with a pin 17A on car frame 5 used as a supporting point is rotated via a rod 16, and a cam 18 which is made in one united body with a small link 18A rotates around the supporting point. Then, as a lever 19 of coupling device 13 rotates counterclockwise (in case of coupling device 13 positioned at the right in FIG. 9) a coupling roller 20 comes close to a stationary roller 21, and thereby rollers 20, 21 couple car door 4 and landing door 1 by putting coupling plate 12 between them.

The conventional elevator door system constructed as described above is capable of achieving a stabilized high speed door opening/closing, as the landing door panel and the car door panel are respectively driven in the vicinity of their centers of gravity, thereby promoting the operating efficiency of an elevator, however, it has such problems as described below.

As the retiring cam is installed at the end of the car frame, the unlocking roller is also installed at the end of the landing door, and as a result, the breadthwise size of a hoistway becomes large.

As the retiring cam is installed at the end of the car, when installing and inspecting it, there is a danger to work while leaning out above the car.

Similarly, when installing the unlocking roller of the landing door on every floor, it is dangerous as the work must be performed while leaning out of the car or a scaffold.

When the doors are kept closed, the bow must be pulled up by exciting the solenoid and therefore, power consumption increases.

The header case of the landing door becomes in complicated construction and cost will become high.

As the bow and the unlocking roller strike each other when unlocking the locked landing door, a large noise is generated.

As a motor of the door machine is installed in a state projecting over the car, a working space around it is narrow. In addition, there is a danger that hand and foot may be caught in by the link lever when it rotates.

SUMMARY OF THE INVENTION

Accordingly, one object of this invention is to provide an elevator door system wherein it is possible to save the elevator installing space.

Another object of this invention is to provide an elevator door system having a simple construction.

Still another object of this invention is to provide an elevator door system which can be installed and adjusted easily.

These and other objects of this invention can be achieved by providing an elevator door system, including a landing door, a car door provided on a car, a latch device for locking the landing door when the landing door is closed. The elevator door system also includes a door locking device provided on the landing door composed of a coupling plate for coupling with the car door, an unlocking plate provided in parallel with the coupling plate, and a link connected between the coupling plate and the unlocking plate for moving the unlocking plate toward the coupling plate. The elevator door system further includes a first linking mechanism for linking the door locking device with the latch device, and a coupling device provided on the car door composed of a pair of coupling rollers for coupling the car door with the landing door, when the car lands a landing floor and the door locking device is positioned between the coupling rollers. One of the coupling rollers of the coupling device pushes the unlocking plate toward the coupling plate when the car lands the landing floor. A displacement of the unlocking plate caused by being pushed toward the coupling plate by the link is applied to the latch device through the first linking mechanism. The latch device unlocks the landing door when the displacement of the unlocking plate is applied. The coupling device couples the car door with the landing door by pushing the door locking device between the coupling rollers of the coupling device when the car lands the landing floor and after the landing door is unlocked, and the car door and the landing door are moved in one unit after the coupling device couples the car door with the landing door.

According to one aspect of this invention, there can be achieved by providing an elevator door system constructed as described below.

A latch is provided at the center above the landing door for locking the landing door when the landing door is closed.

A coupling device is provided on the car door in which two coupling rollers operate to come up to each other through a link mechanism when a cam is rotated.

In addition, an unlocking plate is provided on the landing door which is coupled with parallel links and is restricted only to the parallel movement in parallel with a coupling plate. The latch is connected to parallel links via a connecting rod. When this unlocking plate is pushed against the coupling plate by coupling rollers of the coupling device, the locked landing door is unlocked by the latch.

A door machine is covered with a cover so that its upper plate is usable as a scaffold. In addition, a link lever in the door machine is designed not to project out of the cover when it is operated.

The landing door is unlocked and is coupled with the car door by holding the coupling plate and the unlocking plate with coupling rollers of the coupling device of the car door, and thus, the landing door and the car door are opened/closed.

Further, the cover of the door diving device eliminates the possibility of hand and foot being caught by the link lever and makes a working space on the car wide.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
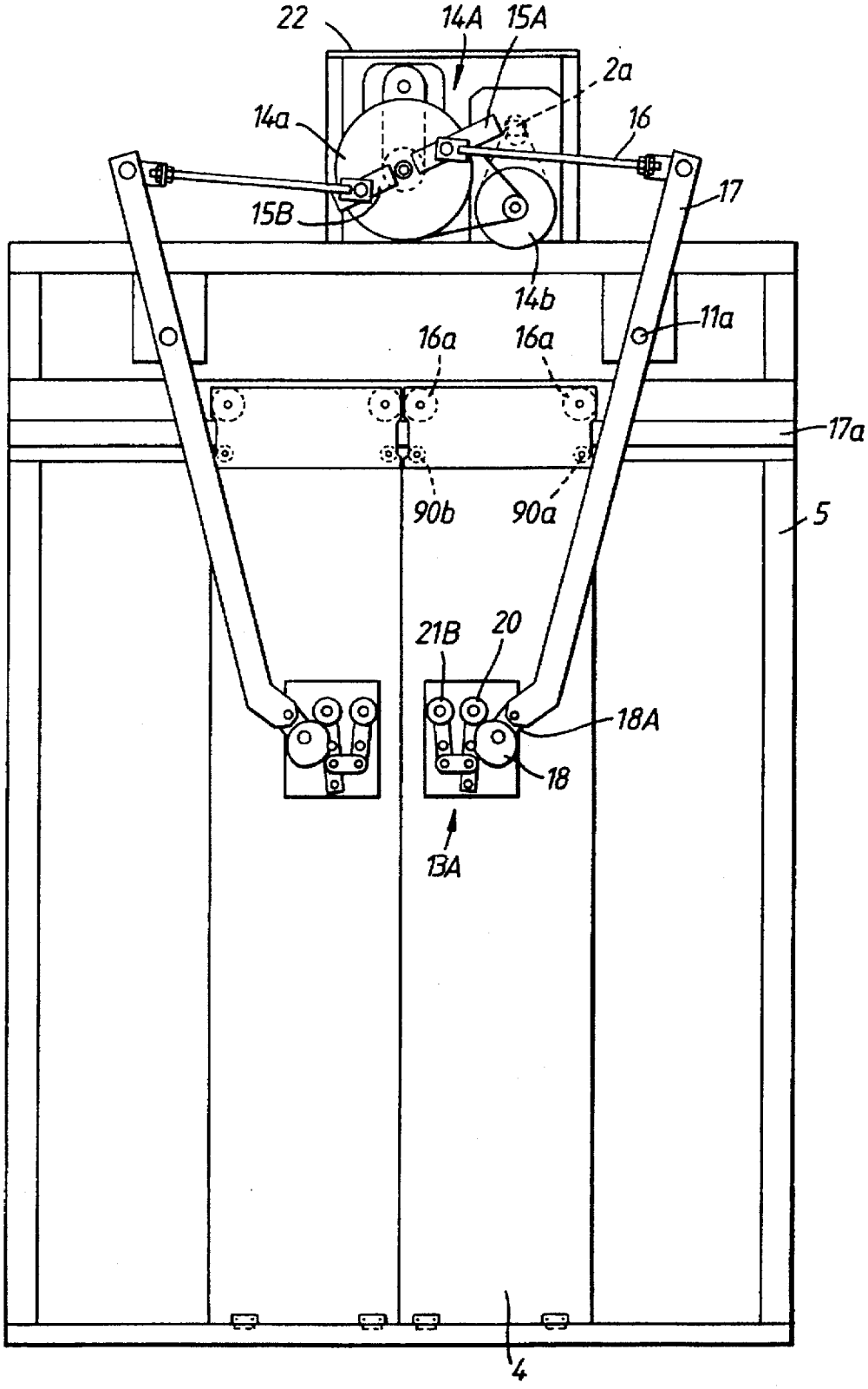
FIG. 1 is a front view of the back of a car door according to an embodiment of this invention when the car door is closed.

Referring now to the drawings, wherein like reference numerals designate identical or corresponding parts throughout the several views, the embodiments of this invention will be described below.

Hereinafter a coupling device and a door locking device at one side only will be described as they have been composed symmetrically against the left and right doors, respectively, unless otherwise described.

Figure 2:
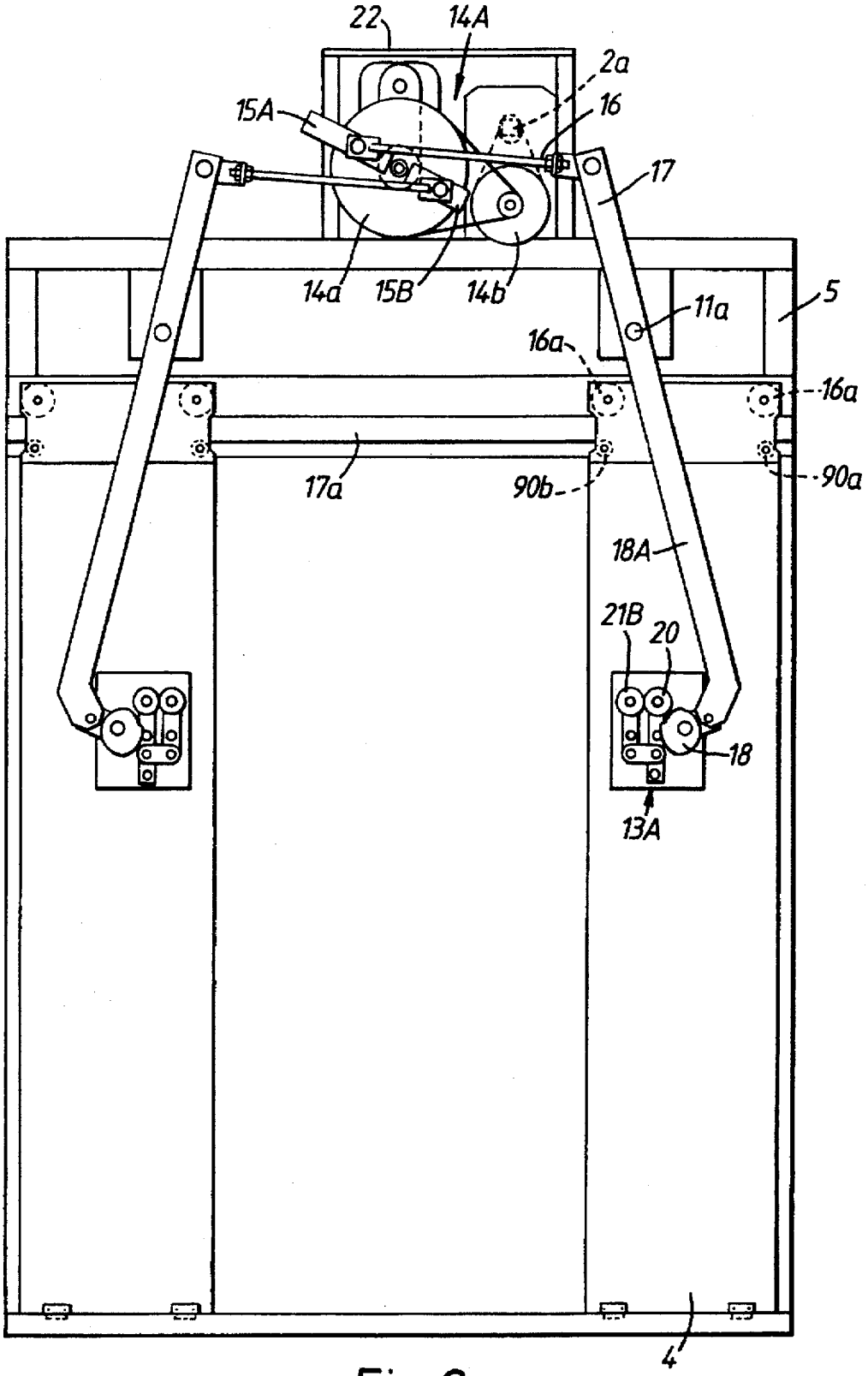
FIG. 2 is a front view of the back of the car door shown in FIG. 1 when the car door is opened.

FIGS. 1 and 2 show respectively front views of the back of a car door according to an embodiment of this invention when the car door is closed (in FIG. 1) and is opened (in FIG. 2). In FIGS. 1 and 2, a door system of car door 4 is composed of a door machine 14A composed of a motor and reduction mechanism, an output rod 16 connecting thereto, a large link 17 for opening/closing car door 4 and a coupling device 13A for coupling with landing door 1. Door machine 14A is assembled by covering its mechanical portion with a cover 22 which is also used as a scaffold. A lever 15A rotates around the center of a sprocket 14*a* but is in length that does not projecting upward from cover 22 used as a scaffold.

Figure 5A:
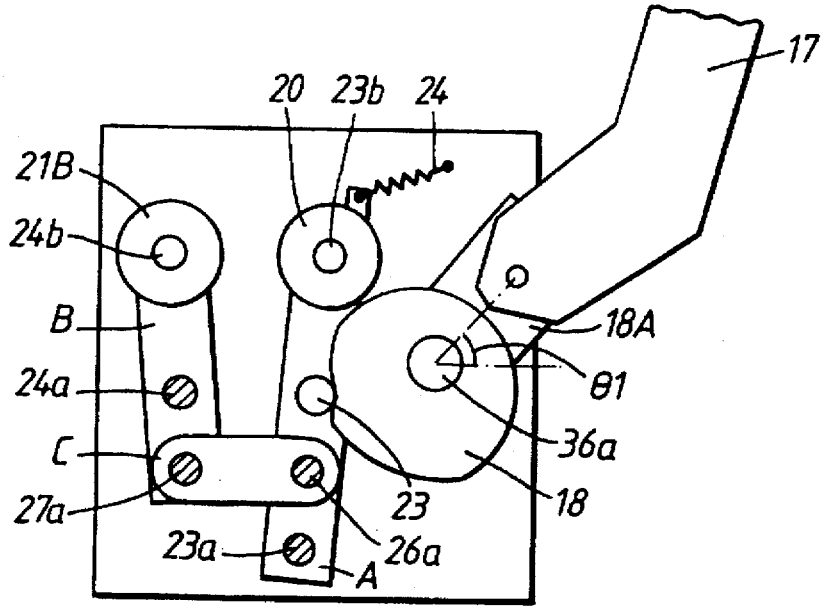
FIG. 5A is a front view of a coupling device of the car door according to an embodiment of this invention when it is closed.
Figure 5B:
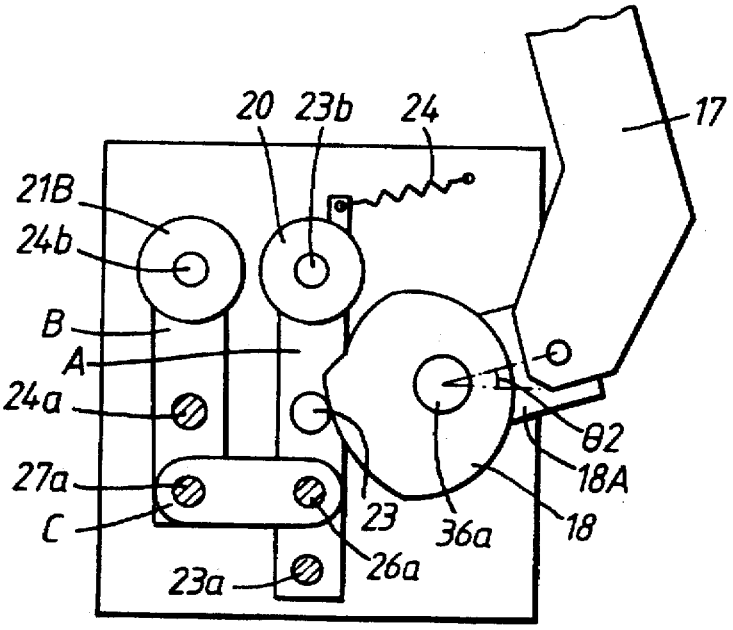
FIG. 5B is a front view of the coupling device of the car door according to the embodiment of this invention when it is opened.

Coupling device 13A which is provided to car door 4 is in such a construction as described below. FIGS. 5A and 5B show front views of coupling device 13A of car door 4 according to an embodiment of this invention when it is closed (in FIG. 5A) and it is opened (in FIG. 5B). In FIGS. 5A and 5B, coupling device 13A is composed of a link A having a pin 23*a* on a base screwed to the panel of car door 4 and a link B which also has a pin 24*a* on the base, a link C which connects link A and link B via pins 26*a* and 27*a*, and a spring 24.

A rubber roller 20 is attached to the other end of link A via a pin 23*b* and, a rubber roller 21B is attached to the other end of link B via a pin 24*b*. Spring 24 is connected to the top of link A and restricts the movement of two rubber rollers 20 and 21B in the state wherein a follower 23 is kept pushed against a cam 18 by connecting link A and link B. A small link 18A is connected to large link 17. Cam 18 connected to small link 18A in one united body rotates on a pin 36*a*. Door coupling device 13A is so composed that small link 18A is set at an initial angle θ1 (an angle when a door is closed as shown in FIG. 5A), and when a door is opened rollers 20, 21B become in the state as shown in FIG. 5B and small link is set at an angle θ2 as shown in FIG. 5B. In this embodiment, it is designed that lever 15A, rod 16, link 17 and small link 18A are so constructed that angle θ2 when a door is opened is always smaller than initial angle θ1. So, when a door is opened, follower 23 touches the convex portion of cam 18, and thereby rollers 20, 21B become in the position keeping a distance therebetween as shown in FIG. 5B.

Figure 3:
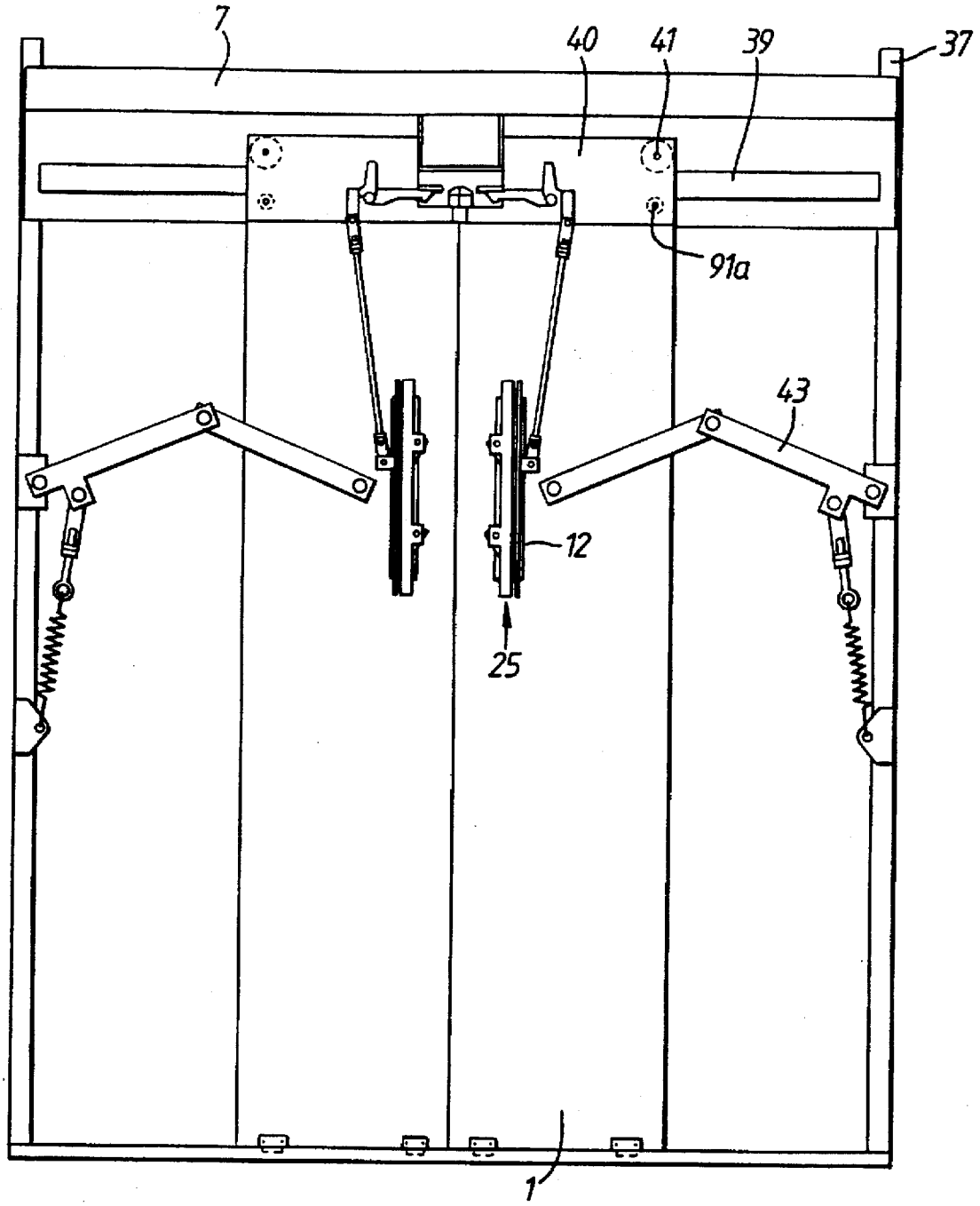
FIG. 3 is a front view of the back of a landing door according to an embodiment of this invention when the landing door is closed.
Figure 4:
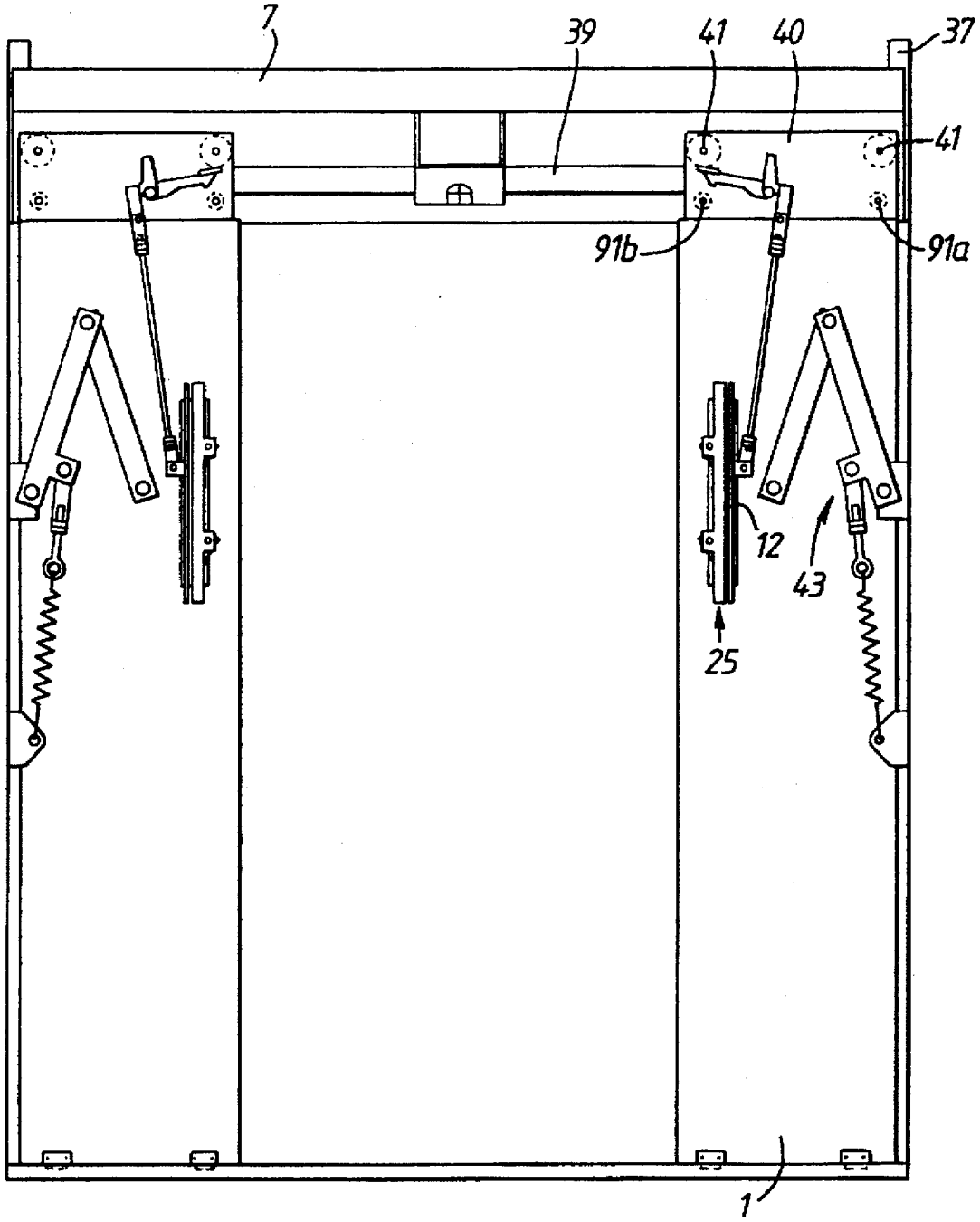
FIG. 4 is a front view of the back of the landing door shown in FIG. 3 when the landing door is closed.

FIGS. 3 and 4 show respectively front views of the back of a landing door according to an embodiment of this invention when the landing door is closed (in FIG. 3) and is opened (in FIG. 4). In FIGS. 3 and 4, landing door 1 is opened/closed on a rail 39 provided on a stationary frame 37 at the building side while being suspended from rollers 41 provided on a hanger 40 at the upper part of landing door 1. On the panel of landing door 1, a door locking device 25 coupled to coupling plate 12 in one united body is assembled to the panel, and further a closer 43 which is constantly applying a closing force to the panel of landing door 1 and the like are provided.

Figure 6A:
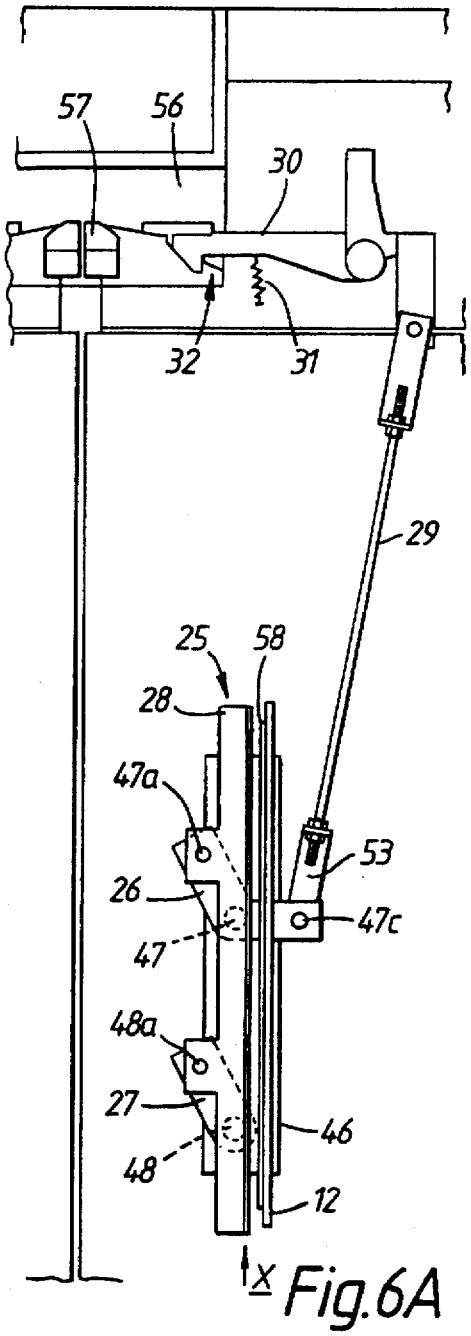
FIG. 6A is a front view of a door locking device of the landing door according to an embodiment of this invention when it is closed.
Figure 6C:
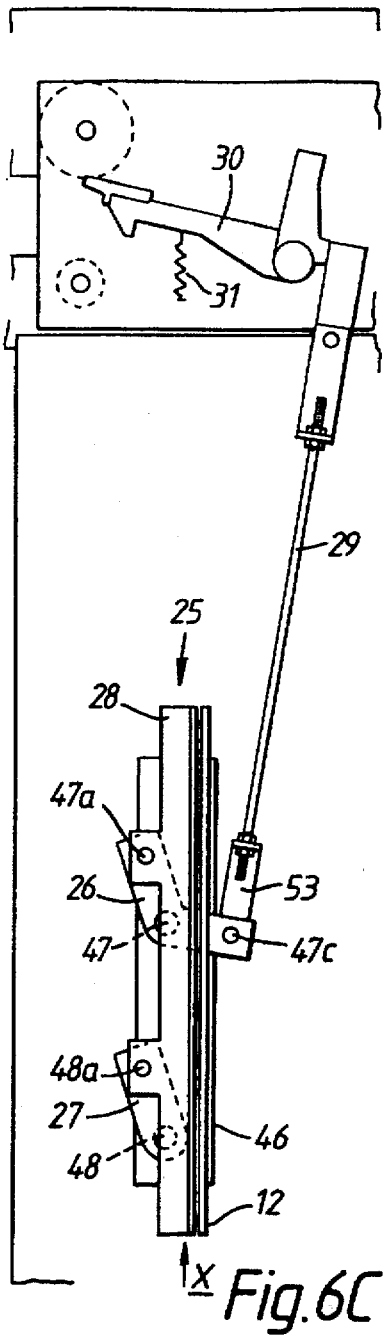
FIG. 6C is a front view of the door locking device of the landing door according to the embodiment of this invention when it is opened.
Figure 6B:
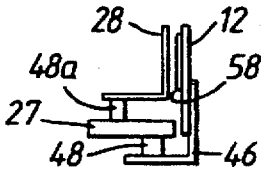
FIG. 6B is a view of the door locking device shown in FIG. 6A in the direction of an arrow X.
Figure 6D:
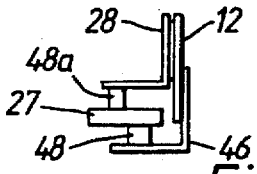
FIG. 6D is a view of the door locking device shown in FIG. 6C in the direction of an arrow X.
Figure 7A:
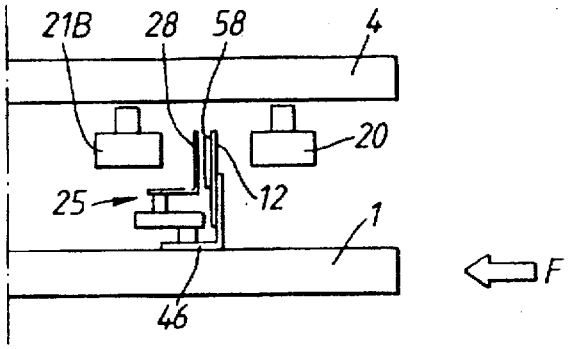
FIGS. 7*a*, 7*b*, 7*c* and 7*d* are an explanatory diagram showing a coupling operation of the car door and the landing door.
Figure 7B:
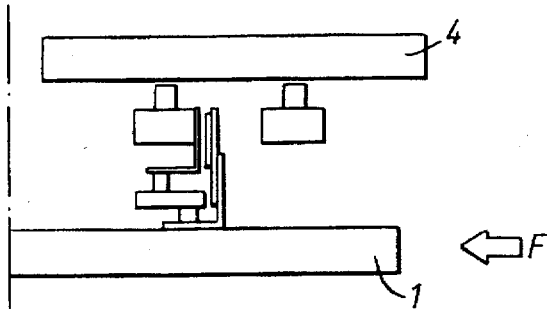
Figure 7C:
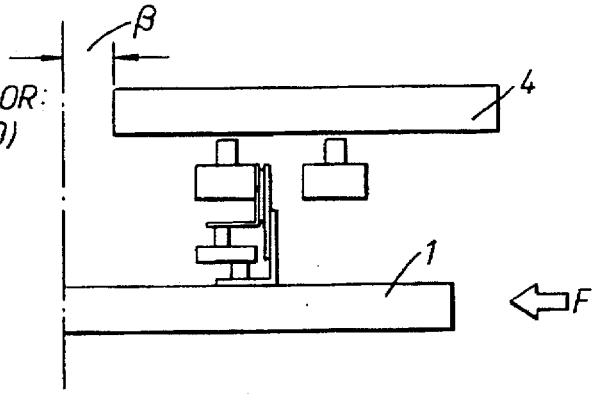
Figure 7D:
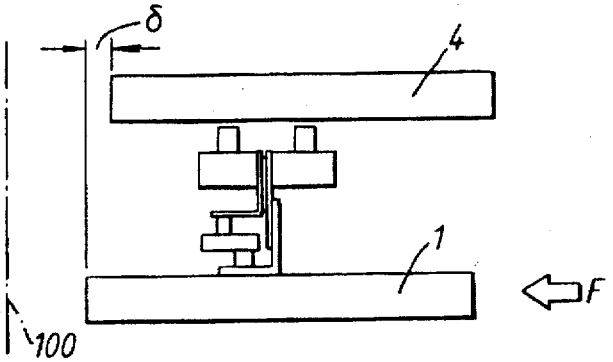
Figure 8:
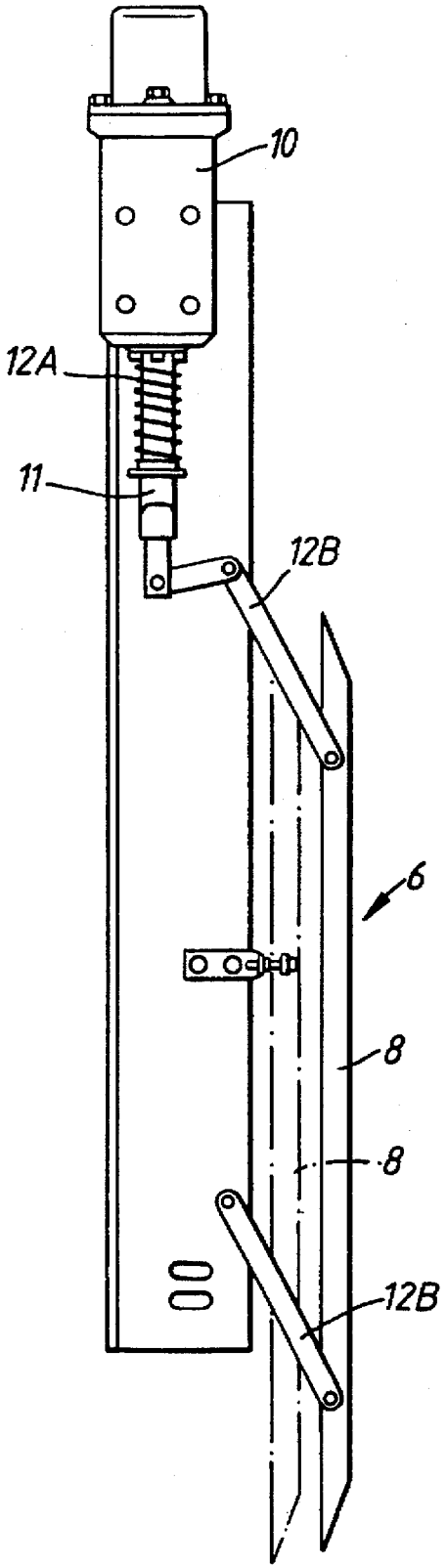
Fig 8 (PRIOR ART)
FIG. 8 is a side view of a conventional retiring cam provided on a conventional car door.
Figure 9:
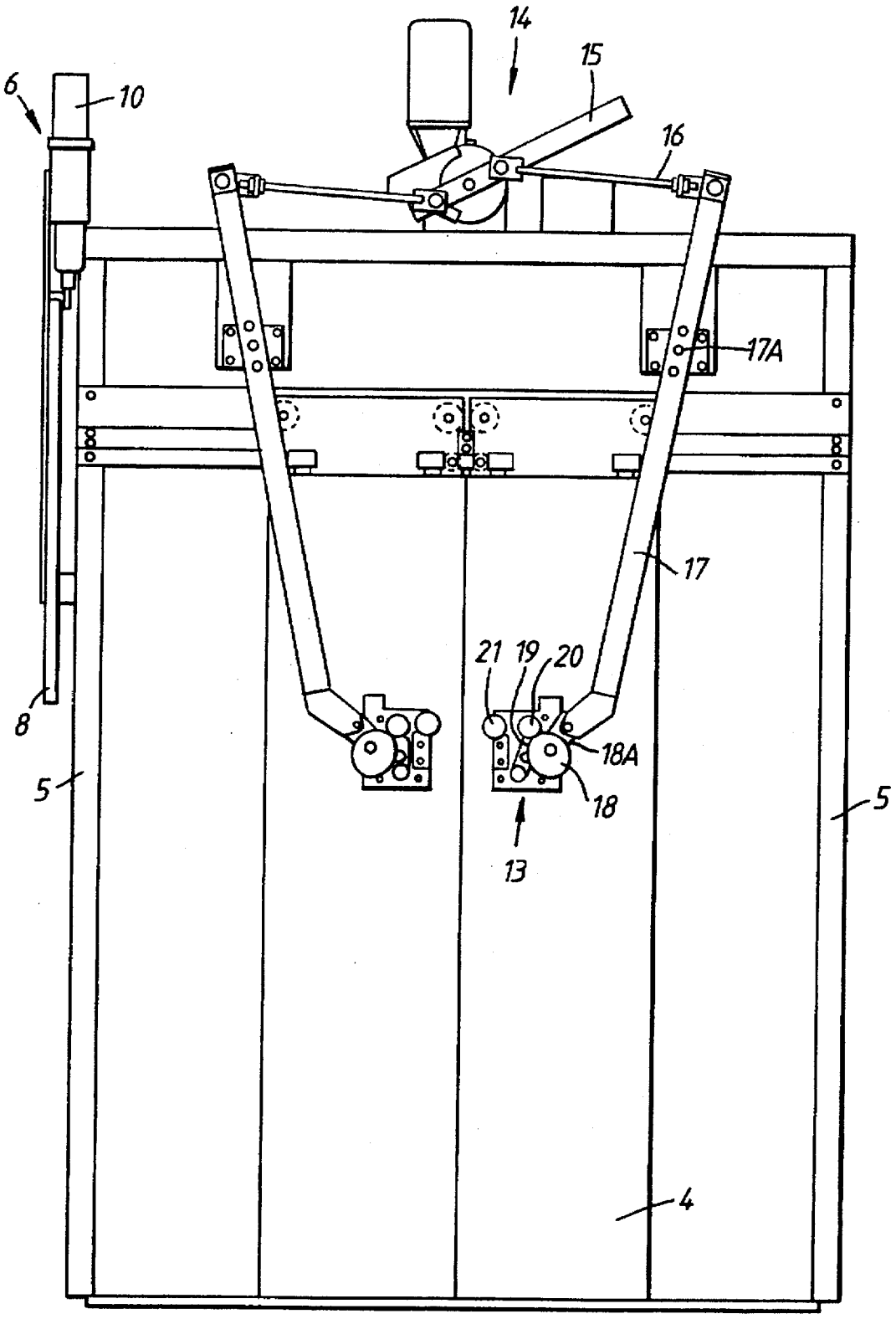
Fig.9 (PRIOR ART)
FIG. 9 is a front view of the back of a conventional car door when the car door is closed.
Figure 10:
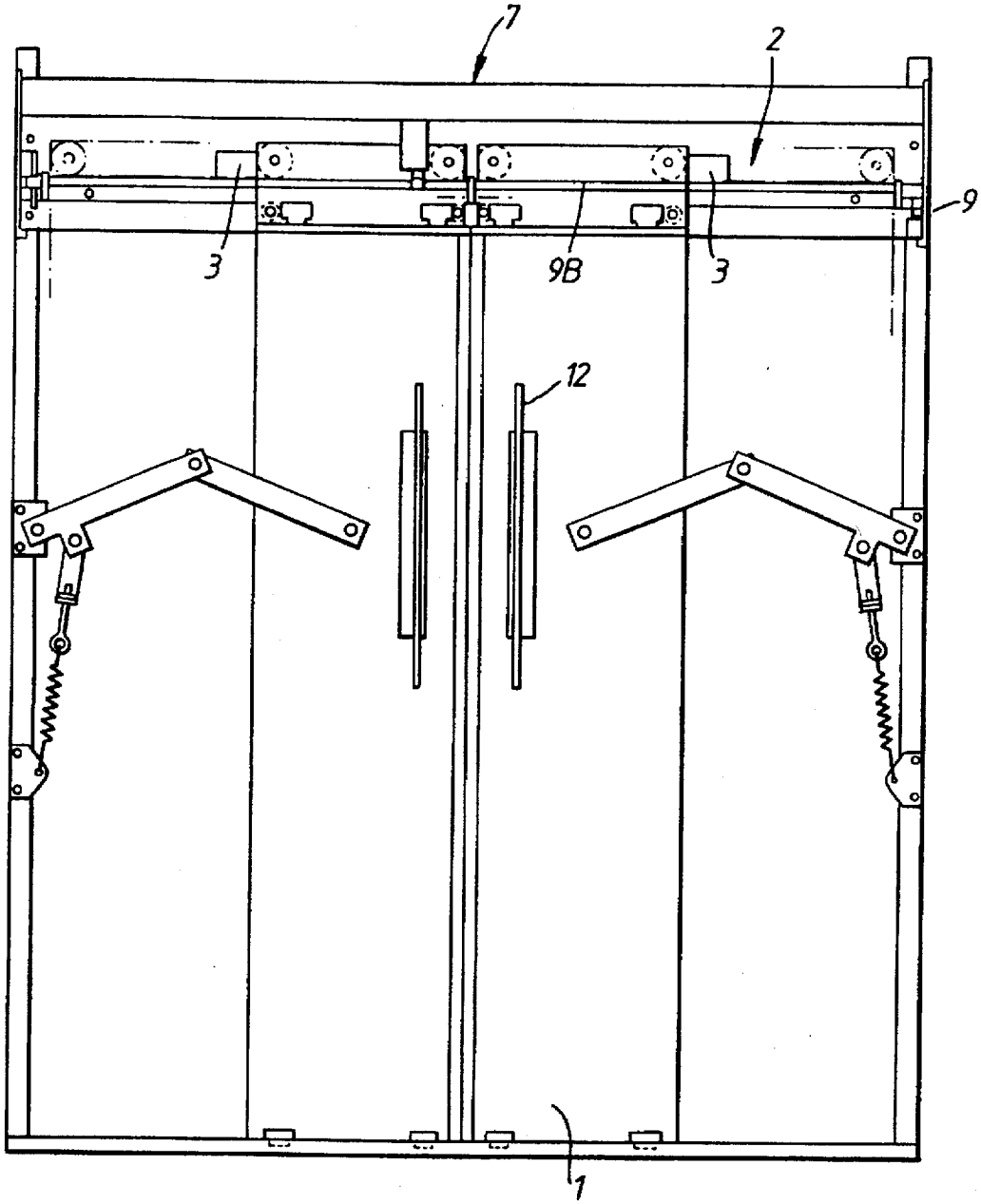
Fig.10 (PRIOR ART)
FIG. 10 is a front view of the back of a conventional landing door when the landing door is closed.
Figure 11A:
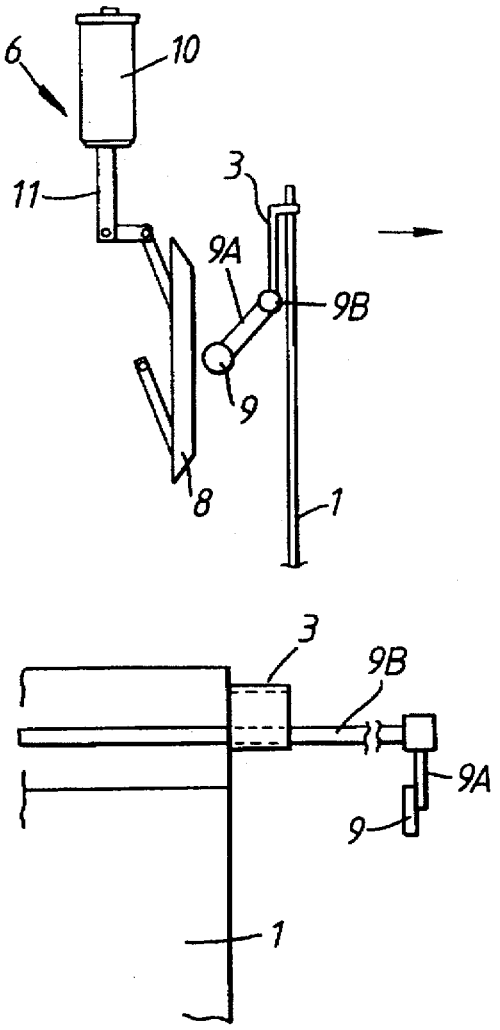
Fig. 11a (PRIOR ART)
FIGS. 11*a* and 11*b* are an explanatory diagram showing an operation of the retiring cam.
Figure 11B:
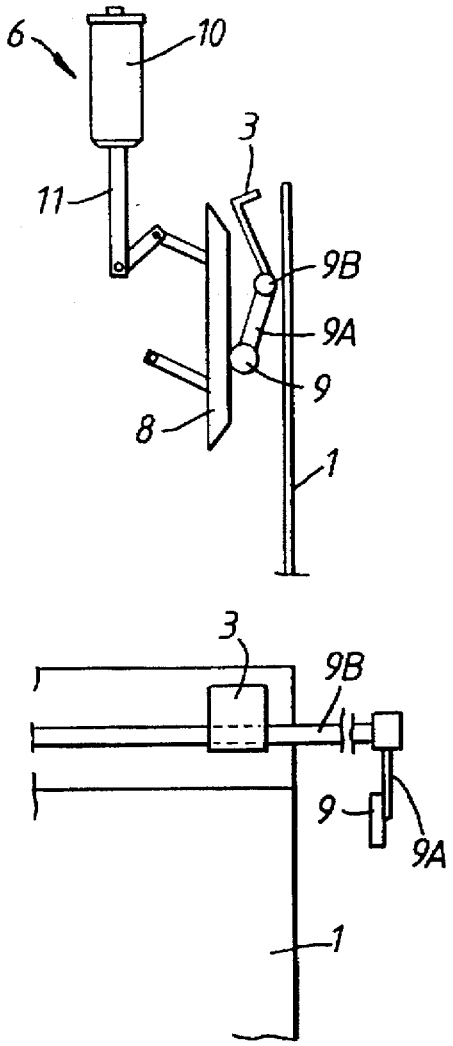
Fig. 11b (PRIOR ART)

FIGS. 6A and 6B show front views of door locking device 25 of landing door 1 according to an embodiment of this invention when it is closed (in FIG. 6A) and it is opened (in FIG. 6C). Furthermore, FIGS. 6B and 6D show respectively views of FIGS. 6A and 6C in the direction of arrows X.

Door locking device 28 of landing door 1 is assembled to conventional coupling plate 12 in one united body.

That is, as shown in FIGS. 6A–6D, links 26, 27 respectively rotate with pins 47, 48 used as supporting points, which are erected on a base 48 of coupling plate 12. Link 26 is in the V-shaped and its one end is projecting to the right side of base 46 from the notch of the base 46. An unlocking plate 28 is attached to links 26, 27 at supporting point of links 26, 27 via rotary pins 47*a*, 48*a*. Unlocking plate 28 is a thin plate and is bent, for example, in the L-shape to keep the strength.

A rod 29 is connected to another supporting point 47*c* of link 26 via a bracket 53 and the upper end of rod 29 is connected to the rear end of a latch 30. Latch 30 is constantly latched on a door lock 32 (a latch bracket) at the landing floor side by a tension spring 31 and balance of gravity.

As the end of latch 30 is kept latched on door lock 32 (the latch bracket) of a switch box 56 when landing door 1 is closed, landing door 1 cannot be opened from the landing floor side. The end of latch 30 is provided with a metal piece which short-circuits a door switch 57 when closing the door, and a car travel OK signal is sent to the controller (not shown). When latch 30 has been lifted up by the unlocking motion as shown in FIGS. 6C and 6D, this signal is not sent and therefore, the car cannot travel.

There is provided a rubber plate 58 adhered to coupling plate 12 side by a bonding agent or a double-sided tape between coupling plate 12 and unlocking plate 28 thereby to reduce noise which is generated when both metallic plates of coupling plate 12 and unlocking plate 28 strike each other.

Coupling plate 12 and unlocking plate 28 are in such lengths that landing door 1 and car door 4 are able to open/close at a difference in levels of landing positions between the landing floor sill and the car sill, which is determined by regulations.

The length of rod 29 is adjustable by changing the nut fastening positions at both ends or one end of rod 29 so as to make a gap between coupling plate 12 and unlocking plate 28 to a proper dimension.

Hereinafter, the operation of this elevator door system described above will be described. In FIGS. 1 and 2, in door machine 14A, the rotary power of a motor output shaft 2*a* is transmitted to link levers 18A, 15B via sprockets 14*b*, 14*a* to rotate link levers 15A, 15B fixed on sprocket 14*a* counterclockwise when opening car doors 4. When closing car doors 4, link levers 15A, 15B are rotated clockwise from the state shown in FIG. 2.

It is designed that lever 15A is longer than lever 15B, or a weight (not shown) is attached to near the tip portion of lever 15A, so as to generate a closing power when closing car doors 4. The plate of car door 4 is installed so that rollers 16*a* rotate on a rail 17*a* fixed to car frame 5 and rollers 90*a*, 90*b* are provided below rail 17*a*, and the panel is restricted to move only in the horizontal direction.

When door machine 14A of car doors 4 operates, link levers 15A, 15B rotate counterclockwise and pull rod 16 to rotate large link 17 which has a supporting point 11*a* is on car frame 5. As a result, small link 18A, which is connected to cam 18 at a supporting point 36*a* on coupling device 13A fixed to the panel of cap door 4, rotates to operate coupling device 13A by cam 18, thus opening the panel of car door 4. When the panel of car door 4 opens, rollers 20, 21B of coupling device 13A move to come near each other according to the movement of follower 23 of which position is restricted by cam 18.

The panel of landing door 1 is moved in the horizontal direction only by rollers 41 over rail 39 and rollers 91*a*, 91*b* under rail 39 along rail 39 of header case 7 on frame 37 fixed to a building, as shown in FIGS. 3 and 4.

When opening the door, unlocking plate 28 is moved laterally by roller 21B of coupling device 13A and is pushed toward coupling plate 12. Then, links 26, 27 rotate clockwise around respective pins 47, 48 to pull rod 29 downward, and thereby latch 30 rotates to unlock landing door 1.

The coupling operation of car door 4 and landing door 1 will be described in the following referring to FIG. 7.

FIG. 7(*a*) shows the operating positional relation between rollers 20, 21B of coupling device 13A and door locking device 25 when doors 1, 4 are closed and the car passes.

When door machine 14A is operated, the panel of car door 4 first begins to move. Interlocking with this movement, rollers 20, 21B also move to come near each other, and then roller 21B of coupling device 13A at the central side of the entrance contacts unlocking plate 28 and becomes the state shown in FIG. 7(*b*).

Further, when the panel of car door 4 is opened, roller 21B pushes unlocking plate 28 against rubber plate 58 of coupling plate 12 and becomes the state shown in FIG. 7(*c*), wherein landing door 1 is unlocked. This state is shown in FIG. 6C.

From this state, the panel of landing door 1 is driven in the opening direction by roller 21B and becomes the state shown in FIG. 7(*b*) when doors 1, 4 are fully coupled.

Here, in FIG. 7(*d*), a difference in level (a gap) δ between the panels of car door 4 and landing door 1 becomes smaller than a difference in level β when unlocked as shown in FIG. 7(*c*). This is because the panel of landing door 1 of which position is restricted by coupling roller 21B catches up to the panel of car door 4 as the velocity of coupling roller 21B to the ground is larger than that of the panel of car door 4 to the ground by the operation of coupling device 13A until doors 1, 4 are fully coupled.

Difference in level δ can be freely set if the moving ratios of rollers 20, 21B are changed by changing the lengths of links A, B and C and the position of pins 23*a*, 24*a*, 26*a* and 27*a* of coupling device 13A shown in FIGS. 5A and 5B.

As the panel of car door 4 is coupled with the panel of landing door 1 in one united body in the state shown in FIG. 7(*d*), it becomes possible to drive the panels of doors 1, 4 at a high speed during the subsequent opening operation. Before becoming the state shown in FIG. 7(*d*), the panel of landing door 1 is in the unstable state, because it is within the range of clearance between coupling rollers 20, 21B, so that it is not possible to drive the panels of doors 1, 4 at a high speed as the vibration of doors 1, 4 is anticipated.

FIGS. 2 and 4 show car door 4 and landing door 1 in the fully opened state, respectively.

The movement of doors 1, 4 when they are closed is entirely contrary to the above-description, and doors 1, 4 are closed from the open state in the order as shown in FIG. 7(*d*), (*c*), (*b*), and (*a*).

When doors 1, 4 begin to close, the panel of landing door 1 is pushed in the closing direction via coupling plate 12.

However, coupling plate 12 and unlocking plate 28 are kept pushed against roller 21B at the central side of the entrance even when rollers 20, 21B begin to open near a closing end 100, because a force shown by an arrow F is constantly applied to the panel of landing door 1 in the door closing direction by closer 43. Therefore, even when rollers 20, 21B are opened and becomes to the intermediate state between FIGS. 1(*d*) and (*c*) in front of closing end 100 of landing door 1, latch 30 is still in the state shown in FIG. 6C without striking locking portion 32. After the panel of landing door 1 is fully closed (after it becomes the state shown in FIG. 1(*c*)), unlocking plate 28 is lowered, and thereby the rear end of latch 30 is pushed upward by rod 29 to the state shown in FIG. 6A and FIG. 7(*b*). As a result, the closing operation of landing door 1 is completed car door 4 is further driven and the closing operation of doors 1, 4 is completed in the state shown in FIG. 7(*a*).

Door locking device 25 when doors 1, 4 are closed is in the state as shown in FIG. 6A. In this time, unlocking plate 28 functions to rotate link 26 counterclockwise by its own weight, and thereby unlocking plate 28 functions to push rod 29 up to maintain latch 30 in the state where it is latched on lock 32. Therefore, even if spring 31 is broken latch 30 will never be put in the unstable state.

When the entrance height and width and the ceiling height of the car differ depending on customer's specification, the height of door machine 14A may become different and the height of coupling device 13A may also become different. In this case, car door 4 can be composed by making the horizontal distance between coupling rollers 20, 21B and angle θ of cam 18 in common dimensions and by changing the lengths of large link 17 and rod 16, the positions of the supporting points on link levers 15A, 15B and the position of the supporting point of car frame 5, etc.

In this case, as for landing door 1, the width and height of the panel of landing door 1 and the width of hanger 40 are to be changed. At the same time, the length of rod 29 should be changed so as to set the center of coupling plate 12 at the height equal to the heights of rollers 20, 21B of coupling device 13A of car door 4.

Various merits as described below are derived from such the construction as described above. It becomes possible to make the adjustment and inspection of the interlock from the center above the car or from the inside of the car, assuring the safe work. The abolishment of the retiring cam makes the minimum breadthwise dimension of a hoistway small, achieving the space saving. Energy consumption is saved as power consumption of the electromagnet of the retiring cam is eliminated and wind sound caused by the retiring cam is eliminated. The header case is simplified, reducing cost. The door locking device and its contacts can be inspected from inside the car by opening the car door, and safety is thus assured.

In the above-described embodiment, the elevator door system is composed of center opening car doors 4 and center opening landing doors 1. This invention is, however, not limited to this embodiment. This invention can be applied to an elevator door system composed of a side opening car door and a side opening landing door.

The present invention can simplify the entrance door and the locking device, improve reliability of the locking and unlocking, save the elevator space and facilitate the installing and adjustment work.

Obviously, numerous modifications and variations of the present invention are possible in light of the above teachings. It is therefore to be understood that within the scope of the appended claims, the invention may be practiced otherwise than as specifically described herein.

What is claimed is:

1. An elevator door system, comprising:

a landing door;

a car door provided on a car;

latch means for locking said landing door when said landing door is closed;

door locking means provided on said landing door composed of a coupling plate for coupling with said car door, an unlocking plate provided in parallel with said coupling plate, and a link connected between said coupling plate and said unlocking plate for moving said unlocking plate toward said coupling plate;

first linking mechanism for linking said door locking means with said latch means; and coupling means provided on said car door composed of a pair of coupling rollers for coupling said car door with said landing door, when said car lands a landing floor and said door locking means is positioned between said coupling rollers;

one of said coupling rollers of said coupling means pushing said unlocking plate toward said coupling plate when said car lands said landing floor;

a displacement of said unlocking plate caused by being pushed toward said coupling plate by said link being applied to said latch means through said first linking mechanism;

said latch means unlocking said landing door when said displacement of said unlocking plate is applied;

said coupling means coupling said car door with said landing door by pushing said door locking means between said coupling rollers of said coupling means when said car lands said landing floor and after said landing door is unlocked; and said car door and said landing door being moved in one unit after said coupling means couples said car door with said landing door.

2. The elevator door system according to claim 1, further comprising:

a door machine provided above said car door for opening and closing said car door; and second linking mechanism provided on said car door for linking said door machine with said coupling means;

wherein said coupling means is driven by said door machine through said second linking mechanism; and said car door and said landing door are moved in one unit after said coupling means couples said car door with said landing door.

3. The elevator door system according to claim 2, wherein:

said coupling means includes a cam provided on the back side of said car door connected to said second linking mechanism for being driven by said door machine through said second linking mechanism; and in said coupling means, said coupling rollers are connected to said cam and move toward each other with interlocking with said cam to push said door locking means between said coupling rollers when said car lands said landing floor and after said landing door is unlocked, and said car door and said landing door are moved in one unit after said coupling means couples said car door with said landing door while minimizing a gap between said car door and said landing door.

4. The elevator door system according to claim 2, wherein:

said door machine is composed of a door driving motor, reduction means, linking mechanism, and a cover for covering outer surface of said door machine; and said cover is used as a scaffold in a construction work of said elevator.

5. The elevator door system according to claim 2, wherein:

said door locking means is composed of a latch and metal fitting provided above said landing door; and said latch couples with said metal fitting to lock said landing door when said landing door is closed.

* * * * *

UNITED STATES PATENT AND TRADEMARK OFFICE

CERTIFICATE OF CORRECTION

PATENT NO. : 5,690,188

DATED : November 25, 1997

INVENTOR(S) : Yasufumi TAKAKUSAKI et al.

It is certified that error appears in the above-identified patent and that said Letters Patent is hereby corrected as shown below:

On the title page, Item [73], the Assignee should read:

-- Kabushiki Kaisha Toshiba, Kawasaki, Japan. --

Signed and Sealed this

Seventh Day of April, 1998

Bruce Lehman

*Attest:*

BRUCE LEHMAN

*Attesting Officer*

*Commissioner of Patents and Trademarks*